US011033957B2

(12) United States Patent
Nitzl

(10) Patent No.: US 11,033,957 B2
(45) Date of Patent: Jun. 15, 2021

(54) CERAMIC REFRACTORY STOPPER

(71) Applicant: Refractory Intellectual Property GmbH & Co. KG, Vienna (AT)

(72) Inventor: Gerald Nitzl, Selb (DE)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 115 days.

(21) Appl. No.: 16/086,597

(22) PCT Filed: Mar. 21, 2016

(86) PCT No.: PCT/EP2016/056131

§ 371 (c)(1),
(2) Date: Sep. 19, 2018

(87) PCT Pub. No.: WO2017/162263

PCT Pub. Date: Sep. 28, 2017

(65) Prior Publication Data

US 2019/0099805 A1 Apr. 4, 2019

(51) Int. Cl.
*B22D 41/18* (2006.01)

(52) U.S. Cl.
CPC ..... *B22D 41/186* (2013.01)

(58) Field of Classification Search
CPC ..... B22D 41/186
USPC ..... 266/217, 271, 272, 220; 222/590, 597, 222/602, 603; 164/337, 415, 437
See application file for complete search history.

(56) References Cited

U.S. PATENT DOCUMENTS 4,791,978 A * 12/1988 Fishier ..... B22D 41/186
164/437

FOREIGN PATENT DOCUMENTS

| | | | | |
|---|---|---|---|---|
| EP | 0625391 | * | 11/1994 | ..... B22D 41/186 |
| EP | 0625391 | A1 | 11/1994 | |
| WO | 9928066 | A1 | 6/1999 | |
| WO | 0108837 | A1 | 2/2001 | |

OTHER PUBLICATIONS

"International Search Report for PCT Patent Application No. PCT/EP2016/056131", dated May 3, 2016, 4 Pages.
"Written Opinion of the International Searching Authority for PCT Patent Application No. PCT/EP2016/056131", dated May 3, 2016, 6 Pages.

* cited by examiner

*Primary Examiner* — Jessee R Roe
*Assistant Examiner* — Michael Aboagye
(74) *Attorney, Agent, or Firm* — Medley, Behrens & Lewis, LLC

(57) ABSTRACT

A ceramic refractory stopper, shaped as a rod with a total axial length LS, comprising a) a stopper body (12) of an axial length LB, a first end section (12U) of which being equipped with means to fasten the stopper body (12) to a raise and lowering device, and a second end section (12L) of which being followed by b) a dome-like stopper head (14) of an axial length LH, wherein c) the stopper body (12) features at least one outer planar surface section (P1, P2, P3), which extends along at least 50% of the axial length LB of the stopper body (12).

13 Claims, 4 Drawing Sheets

CERAMIC REFRACTORY STOPPER

Figure 1:
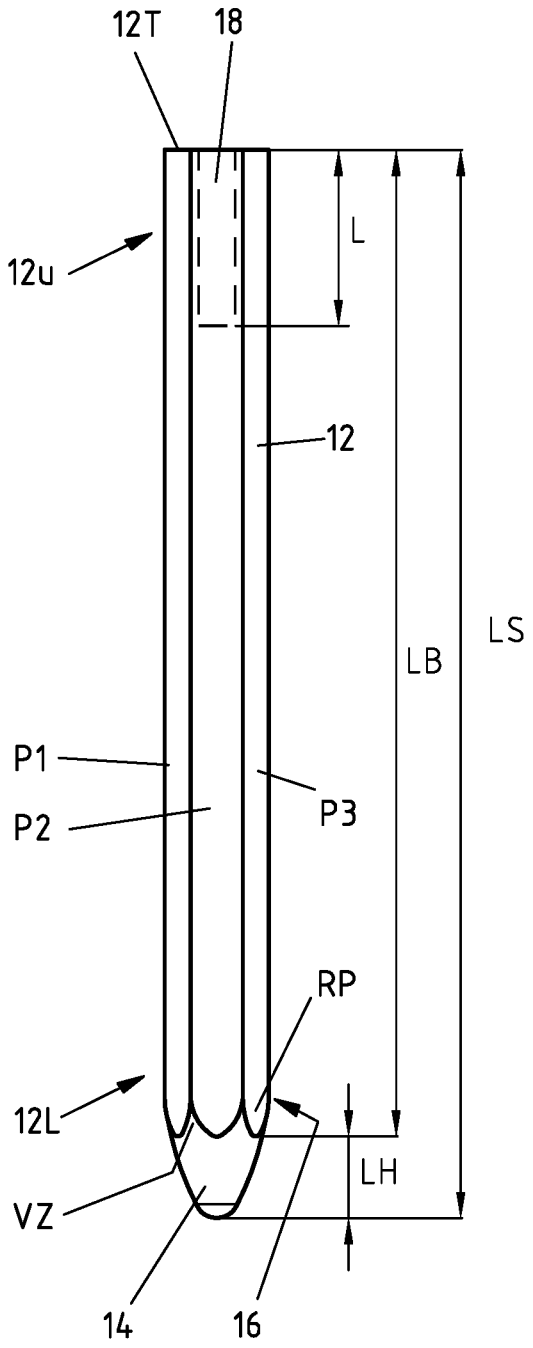

The invention relates to a ceramic refractory stopper (a stopper device) for controlling a flow of molten metal at an outlet opening of a metallurgical vessel, such as a tundish.

The generic type of a ceramic refractory stopper is rod-shaped and comprises a stopper body of an axial length LB, a first end section of which being equipped with means to detachably fasten the stopper body to a raise and lowering device, and a second end section, which is followed, in an axial direction of the stopper, by a so-called dome-like stopper head of an axial length LH. In particular the term "dome-like shape" includes spherical or pencil shaped (conical) configurations, but the specific design (shape) of the so-called dome-like stopper head is not crucial as far as it allows the required control of the metal flow, although in most cases circular cross-sections apply. The rod-shaped stopper defines a central longitudinal axis.

It is well known in steel casting to arrange such a stopper rod, which in many cases is a one-piece-stopper rod, in a vertical position, in order to vary the cross-sectional area of an associated outlet opening of a corresponding metallurgical vessel by said lifting/lowering action.

Insofar the first end of the stopper body is its upper end in a use position and the free end of the dome-like stopper head defines the lowermost part of the stopper. That part of the stopper body extending downwardly from its first end is called its first (upper) section, while the part of the stopper body adjacent to the stopper head is called its second (lower) section.

Any directions disclosed hereinafter, like "top", "bottom", "upper and lower ends" always refer to the use position of the stopper with its longitudinal axis running vertically.

Stopper rods of this type have also being used to introduce a gas, such as an inert gas, like argon, into the molten steel for avoiding clogging of non-metallic inclusions in the submerged entry nozzle. Such stoppers are characterized by a central gas channel for blowing the gas, entering the stopper body at its first end, along the gas channel, extending through the stopper body into the stopper head and from there to at least one outlet opening at an outer surface of the stopper head.

This common rod shape, i.e. an elongated shape, of generic stoppers is further characterized by a circular cross section (transverse section) of more or less constant diameter along the stopper body and of decreasing diameter between an upper and lower end of the stopper head. It is also known to vary the circular cross-section of a stopper body between its first and second section. Common stoppers are mostly manufactured by isostatic pressing.

Such stoppers have proved successful over decades. Nevertheless there is a continuous demand to improve such stoppers in view of their manufacture and handling.

Before this background trials were made to optimize the design of a stopper (rod), starting from a generic stopper rod with a circular cross section of a diameter D.

It was found that the structural integrity of the stopper is not affected if the stopper body displays at least one outer planar surface section on the outer peripheral surface of the stopper body wherein said planar surface section extends along the axial extension of the stopper body. In other words: its circular cross section features at least one secant; the cylindrical stopper body is flattened by at least one flat outer/circumferential surface section which extends axially with respect to the overall stopper.

This planar surface section provides numerous advantages compared with a generic stopper rod of cylindrical shape, i. a.:

- The elongate planar surface reduces the amount of refractory material needed to produce the stopper and thus reduces the costs.
- The axially extending planar surface section improves handling of the stopper and avoids the stopper from rolling away.
- It further optimizes the storage and packaging, as less space being needed.

It seems obvious that these features can only be realized reliably, if the secant mentioned (the flattened part) will cut less than half of the circular cross section of a conventional stopper body. This is true in particular for a stopper, which features a central and axial gas channel as the existence and functionality of the gas channel should not be affected.

In its most general embodiment the invention relates to a ceramic refractory stopper, shaped as a rod, with a total axial length LS, comprising

- a stopper body of an axial length LB, a first end section of which being equipped with means to fasten the stopper body to a raise and lowering device, and a second end section of which being followed by
- a dome-like stopper head of an axial length LH, wherein the stopper body features at least one outer planar surface section, which extends along at least 50% of the axial length LB of the stopper body.

The basic idea is the flattened (planar) outer surface of the stopper body and may be varied by providing the stopper body with more than one planar surface section (along the same axial positions) to achieve a polygonal cross sectional profile, such as

- a triangle,
- a rectangle, in particular a square,
- a pentagon,
- a hexagon,
- a heptagon, etc.

For example: a stopper body with a hexagonal or octagonal cross section has six or eight planar surface sections, and leads to considerable reductions in weight and optimizations in handling, transport and storage, compared with a conventional stopper with cylindrical stopper body.

4, 6, 8 or 10 planar outer surface sections make stacking easier and allow the use of a conventional socket wrench for manipulating. More than 8 or 10 planar outer surface sections do not provide further advantages.

The following table displays the reduction of the overall cross-section (cross-sectional area) and correspondingly the relative reduction of the overall weight of the stopper body (and indirectly of the whole stopper rod) compared with a generic stopper rod of circular cross section (reference) with the proviso that the lines/edges between adjacent planar surface sections run within the (same) cylindrical surface of this reference stopper (i.e. the maximum horizontal extension is the same in all stopper bodies):

| circular | square | pentagon | hexagon | octagon |
|---|---|---|---|---|
| 100 | 64 | 76 | 83 | 90 |

This effect can be increased with stoppers, featuring a central bore (gas channel), which cross section is amended in the same or similar manner, i.e. changed from a common circular cross section to a polygonal cross section with the proviso that the reduction in weight (and correspondingly the reduction in material) gets even higher, if the inner profile (the planar surface sections) of this gas channel displays tangents with respect to a generic circular gas channel of a generic stopper or displays only short secants with respect to such circular channel.

To achieve a constant wall width (thickness) one embodiment of the stopper is characterized by a parallel arrangement of the outer planar (flat) surface sections of the stopper body and the planar inner surface sections of the gas channel.

According to one embodiment the dome-like stopper-head features a circular cross section (always seen along a plane, which runs perpendicular to the central longitudinal axis of the stopper/stopper body) at least at its (upper) end section adjacent to the (lower) second end section of the stopper body.

As far as the planar outer surface sections of the stopper body should extend at least along 50% of its axial length LB, this is the "lower limit" to allow the advantages described in a reliable manner, while larger extensions (>60%, >70%, >80%, >90%) are even more favourable.

These values include the following: The stopper head has a dome-like shape, i.e. substantially circular cross sections along planes, which run perpendicular to the central longitudinal axis of the stopper/stopper body, to allow reliable functioning as a control means, when the stopper is lowered or lifted with respect to a corresponding circular opening of a metallurgical vessel. The new stopper body design is characterized by a polygonal profile. Insofar the overall profile changes from polygonal to circular. To avoid corresponding edges and thus any notching effect at the transition bank of polygonal stopper body and the dome-like stopper head, the invention provides for a transition zone at the lower second end of stopper body to allow a smooth transition between stopper body and stopper head.

This transition area may be realized by a smoothly changing transition surface between the stopper head and stopper body, or generally spoken: by the avoidance of any sharp edges and notching effects.

This can be realized in accordance with the shape of a pencil such that the planar outer surface sections display a convex (or curved or tapered) surface profile at their lowermost end sections. Correspondingly A-shaped area are formed between adjacent convex ends (seen in an axial direction of the stopper) of planar outer surface sections.

In other words: The transition area describes that part of the stopper where the non-circular cross-section of the stopper body is left, while the pure circular cross-section of the stopper head has not been reached yet.

Independently of the aforesaid it is preferred that the said planar outer surface section(s) of the stopper body run all the way down from the upper top-surface of the stopper body to the stopper head or to said transition region respectively and thus in most cases up to 80%, up to 90% or more of that part of the stopper body with non-circular cross sections. One or more of said planar outer surface sections can be split into two or more discrete zones, arranged at an axial distance to each other.

The inventive design can be realized with a stopper, wherein stopper body and stopper head provide a one piece stopper, a so called monobloc stopper It is also possible to design stopper body and stopper head separately as discrete parts, which are fastened to each other by at least one means of: glue, mortar, tongue and groove, thread and screw, bayonet.

The inner channel (gas channel), mentioned above, can extend from the upper first end of the stopper body

- into the stopper body, i.e. it ends within the stopper body, or
- through the stopper body and into the stopper head, i.e. it ends in the stopper head, or
- through the stopper body and through the stopper head, with one or more openings in the outer surface of the stopper head, to allow the gas to be fed into a corresponding metal melt.

In the latter case the channel may have a smaller cross-section at a section within the stopper head and a larger cross section at its section extending through the stopper body.

Independently of its design with or without a central (gas) channel a rotationally symmetrical design has the advantage of substantially constant physical properties of the overall stopper. This includes shapes with planar outer surface sections of the same axial length and/or the same width.

As mentioned above a stopper with outer planar surface sections not only allows material reductions but gives the possibility of other manufacturing techniques.

The new stopper design can be realized in a hydraulic press (i.e. even by uniaxial pressing), wherein the pressing step may be executed under a horizontal arrangement of the mould, for example in a two-piece (two-part) mould, and thus in a horizontal arrangement of the stopper rod, which makes manufacturing easier, faster and cheaper.

Instead of an isostatic press an extruder may be used to manufacture the stoppers.

Even packing becomes easier as polygonal and smaller wrappings (packing units) can be used. Polygonal (non-circular) wrappings may be thinner as they are stiffer than circular ones.

Further features of the invention become apparent from the features of the sub-claims and the following description of various embodiments of the invention, wherein features, displayed for one embodiment, may be arbitrarily realized as well with other embodiment, if not explicitly excluded or technically absurd.

The attached drawings displays—in a schematic way—in

Figure 2:
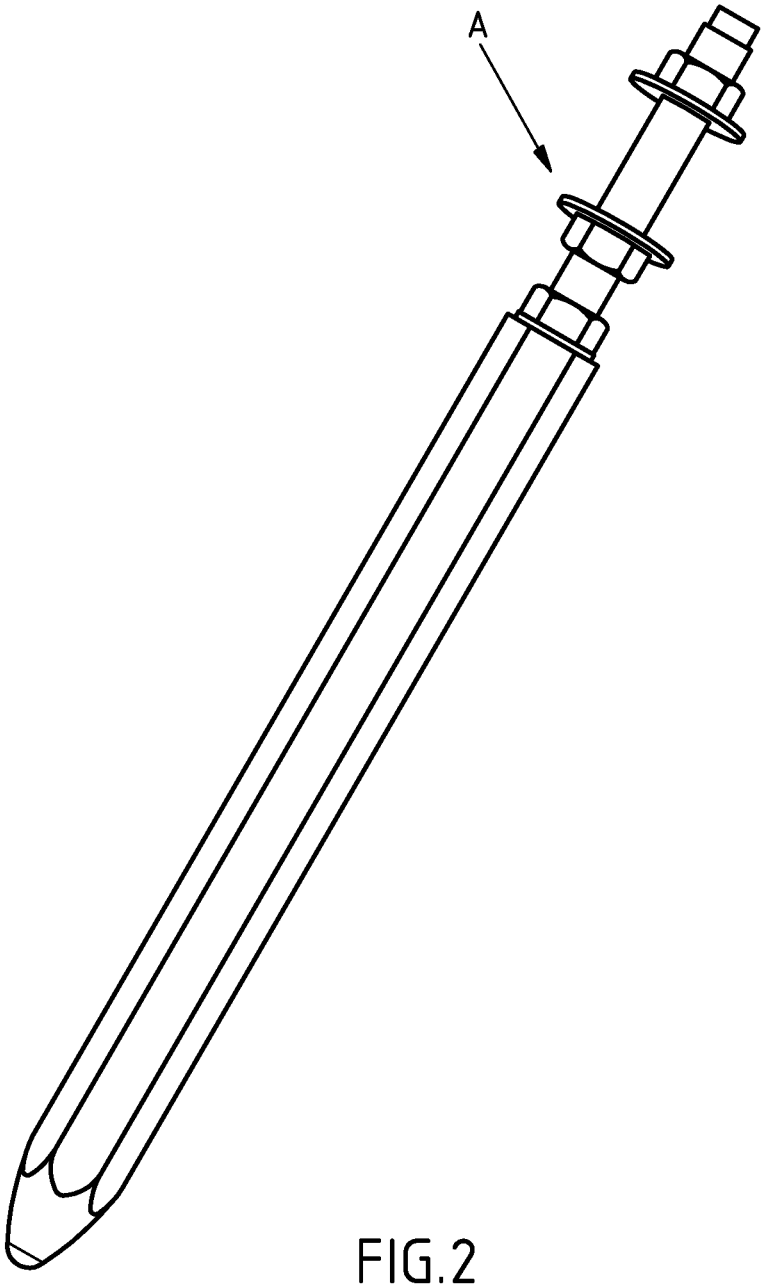
Figure 3:
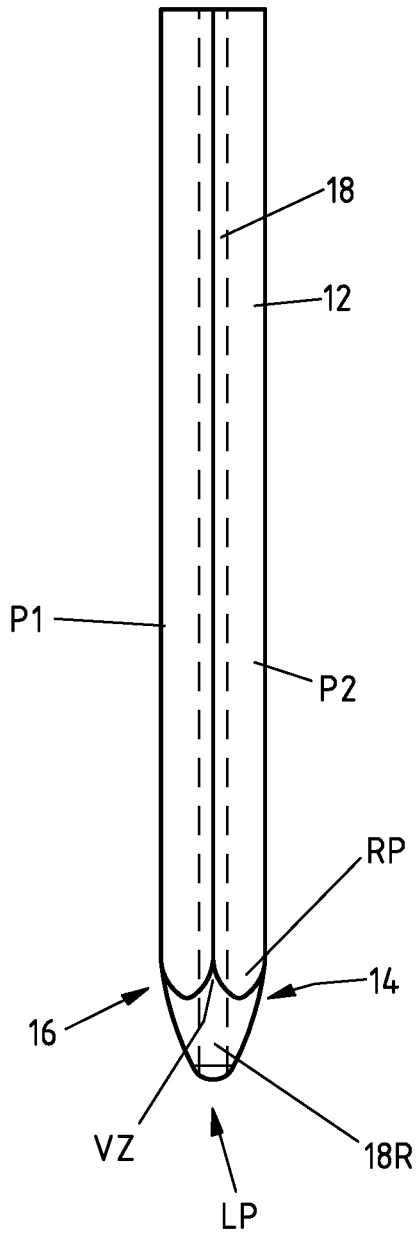
Figure 4:
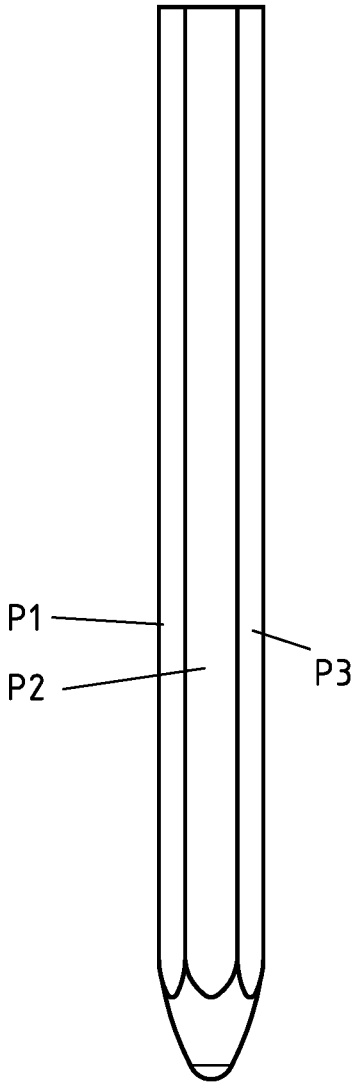
Figure 5:
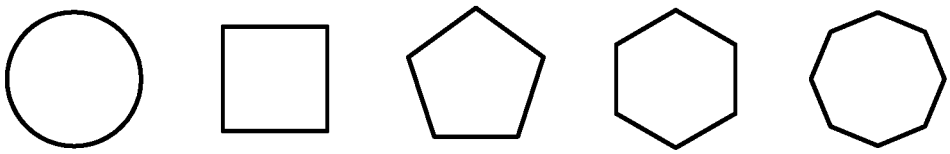

FIG. 1: a first embodiment of a stopper rod with a hexagonal profile of the stopper body FIG. 2: the stopper of FIG. 1 with associated fixing means FIG. 3: a second embodiment of a stopper rod with a square profile of the stopper body FIG. 4: a third embodiment of a stopper rod with a pentagonal profile of the stopper body FIG. 5: cross-sections of stopper bodies in accordance with the table disclosed above.

wherein FIGS. 1, 3 and 4 each displays the stopper in a use position. In the Figures identical or functionally equivalent features are displayed by the same numerals.

FIG. 1 is a front view of a first embodiment of a refractory ceramic stopper shaped as a rod with a total axial length LS, comprising a stopper body 12 of an axial length LB, which is followed at a second end section 12L (including a so-called transition region 16) by a dome-like stopper head 14 of an axial length LH. The stopper body 12 features six planar surface sections, three of which (P1, P2, P3) may be seen in FIG. 1, in an rotationally symmetrical arrangement.

These planar (flat) surface sections P1, P2, P3 each extend from an upper top surface 12T of the stopper body 12 along the axial length LB of the stopper body 12, wherein the lower part of the end section 12L defines the transition region 16.

This transition region 16 provides a smooth surface transition between the hexagonal profile (cross-section) of the stopper body 12 and the dome-like stopper head 14. The design displayed in FIG. 1 is similar to that of a pencil.

It may be seen from FIG. 1 that the planar surfaces P1, P2, P3 end with rounded profiles RP (convex shape, seen in an axial direction of the stopper) in said transition zone 16. Accordingly a wave-like pattern is achieved with A-shaped zones VZ between said rounded profiles RP. The axial length of the transition region 16 corresponds to about 5% of the total length LS, while generally 1-10% of the total length LS seem proper.

The stopper head 14 is dome shaped and characterizes that part of the stopper featuring a substantially ideal circular cross-section below the second end section 12L or transition region 16 respectively.

The overall shape of this stopper type resembles that of a pencil.

An upper, first end section 12U of the stopper body 12 is equipped with a circular bore hole 18, which extends along a length L from the upper top surface 12T into the stopper body 12 and serves to receive a metallic or ceramic screw nut (non displayed) as means to fasten the stopper to a (non displayed) raise and lowering device.

FIG. 2 shows an adapter A of such a handling device which is fixedly secured at the said screw nut.

The stopper of FIG. 3 is similar to that of FIG. 1,2 with the proviso that the stopper body 12 has a square cross section over its length, thus providing four outer planar surface sections, two of which (P1, P2) may be seen in said Figure.

This stopper is further characterized by a gas channel 18, which extends from top surface 12T through stopper body 12 and stopper head 14 and ends at the lowermost point LP of said stopper head 14 in a corresponding opening.

The cross section of this gas channel 18 is square as far as it extends along the stopper body and then changes, via a transition area, into a circular profile of reduced cross area, displayed by 18R.

Means for fixing this stopper to a lifting devices as well as means to connect the gas channel to a gas supply unit are not displayed as being prior art and known to the skilled person.

A third embodiment of a stopper rod with a pentagonal profile of the stopper body is disclosed in FIG. 4, again in a front view, so that only three flat surface sections P1, P2 and P3 can be seen.

FIG. 5 displays five cross-sections of stopper bodies in accordance with the table disclosed above, namely—from left to right—:

a conventional circular cross section
the square profile according to FIG. 3
the pentagonal profile according to FIG. 4
the hexagonal cross-section of FIG. 1,2
an octagonal cross-section

The invention claimed is:

1. Ceramic refractory stopper, shaped as a rod with a total axial length LS, comprising a) a stopper body (12) of an axial length LB, a first end section (12U) of which being equipped with means to fasten the stopper body (12) to a raise and lowering device, and a second end section (12L) of which being followed by b) a dome-like stopper head (14) of an axial length LH, wherein c) the stopper body (12) features multiple outer planar surface sections (P1, P2, P3), which extends along at least 50% of the axial length LB of the stopper body (12).

2. Ceramic refractory stopper according to claim 1, the stopper body (12) of which features a polygonal outer cross section along at least 50% of its axial length LB.

3. Ceramic refractory stopper according to claim 1, the stopper body (12) of which features a square, hexagonal or octagonal outer cross section along at least 50% of its axial length LB.

4. Ceramic refractory stopper according to claim 1, the dome-like stopper-head (14) of which features a circular outer cross section at least at its end section adjacent to the second end section (12L) of the stopper body (12).

5. Ceramic refractory stopper according to claim 1, with a transition area (16) at the lower end (12L) of the stopper body (12) and adjacent to the stopper head (14), wherein a lower end (RP) of the at least one outer planar surface section (P1, P2, P3) of the stopper body (12) merges smoothly into the dome-like stopper head (14).

6. Ceramic refractory stopper according to claim 1, wherein stopper body (12) and stopper head (14) provide a one piece stopper.

7. Ceramic refractory stopper according to claim 1, wherein stopper body (12) and stopper head (14) are discrete parts, which are fastened to each other by at least one means of a group comprising: glue, mortar, tongue and groove, thread and screw.

8. Ceramic refractory stopper according to claim 1, with a channel (18), extending from a top surface (12T) of the stopper body (12) into the stopper body (12) or through the stopper body (12) and into the stopper head (14), or through the stopper body (12) and through the stopper head (14).

9. Ceramic refractory stopper according to claim 8, wherein the channel (18) has a smaller cross-section along its section (18R) within the stopper head (14) and a larger cross-section along its section extending through the stopper body (12).

10. Ceramic refractory stopper according to claim 8, wherein the channel (18) has one or more planar surface sections, extending parallel to the outer planar surface sections (P1, P2, P3) of the stopper body (12).

11. Ceramic refractory stopper according to claim 8, wherein said channel (18) has the same number of planar surface sections compared with the outer planar surface sections (P1, P2, P3) of the refractory body (12).

12. Ceramic refractory stopper according to claim 1 with a maximum number of outer planar surface sections of 8 or 10.

13. Ceramic refractory stopper according to claim 1, which is rotationally symmetrical.

* * * * *